United States Patent [19]

Scott

[11] 4,237,802

[45] Dec. 9, 1980

[54] TUFTING MACHINE MONITOR

[75] Inventor: Jimmie D. Scott, Harrison, Tenn.

[73] Assignee: Tooling and Machine Development, Inc., Chattanooga, Tenn.

[21] Appl. No.: 33,107

[22] Filed: Apr. 25, 1979

[51] Int. Cl.[3] ..... D05C 15/00

[52] U.S. Cl. ..... 112/79 A; 112/266.2

[58] Field of Search ..... 112/79 R, 79 A, 121.11, 112/275, 277, 121.12, 121.15, 266.2; 66/212, 210

[56] References Cited

U.S. PATENT DOCUMENTS

| | | | |
|---|---|---|---|
| 2,932,181 | 4/1960 | MacCaffray | 66/210 |
| 3,626,725 | 12/1971 | Fertig et al. | 66/212 X |
| 3,668,904 | 6/1972 | Murenbleeld | 66/212 |
| 3,781,532 | 12/1973 | Dorsman et al. | 66/212 |
| 3,961,500 | 6/1976 | Braley et al. | 66/210 |

*Primary Examiner*—Ronald Feldbaum
*Attorney, Agent, or Firm*—Alan Ruderman

[57] ABSTRACT

A tufting machine having belt and pulley drive system for driving the yarn feed rolls and backing fabric feed rollers from the main shaft has rotational speed sensors for determining the rotational speed of the main shaft, the yarn feed rolls, the input shaft to the fabric feed rollers, and the front and rear fabric feed rollers. Each sensor emits a pulse whenever a tooth of a gear on the shaft passes so that a pulse train is generated. The pulse trains are transmitted through selector switch to a speed ratio indicator and to a digital tachometer. The speed ratio indicator displays the ratio of the selected signals so that representations of pile height, density, stitches per inch of backing fabric can be monitored.

20 Claims, 5 Drawing Figures

Fig. 1
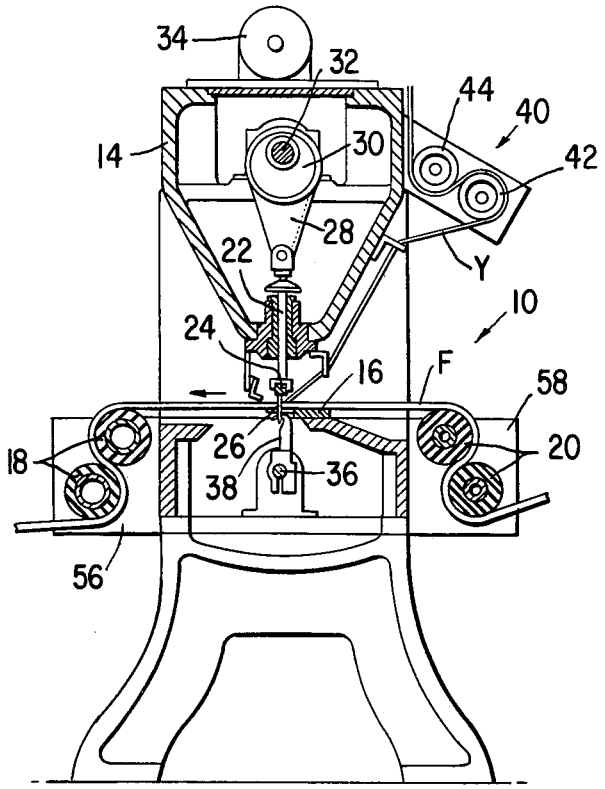
Fig. 2
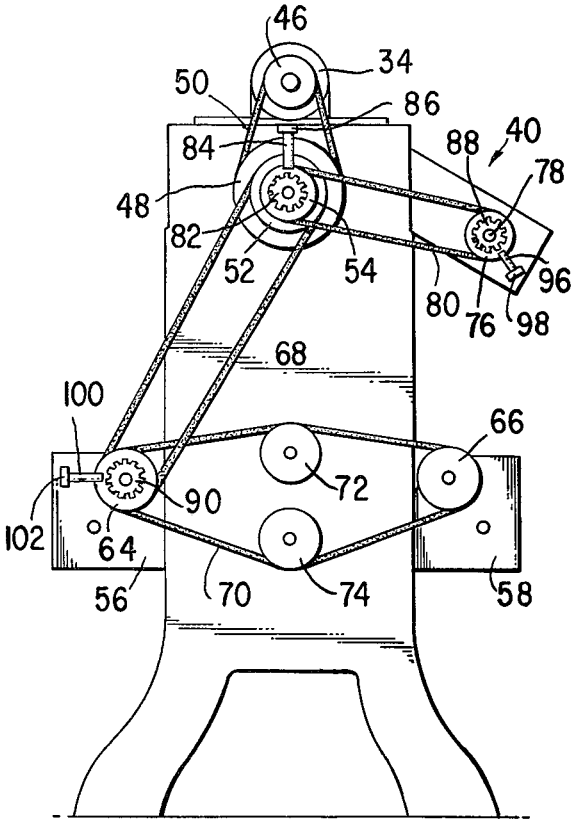
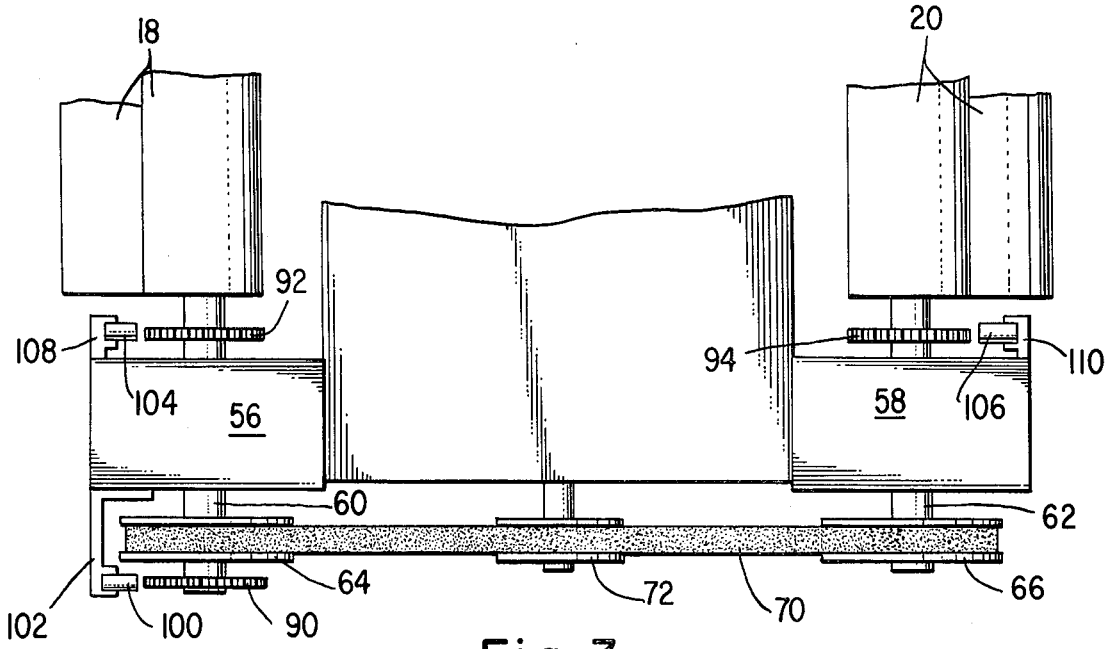
Fig. 3

TUFTING MACHINE MONITOR

BACKGROUND OF THE INVENTION

This invention relates to tufting machines and more particularly to apparatus for monitoring the significant parameters of a tufting machine for reducing initial set-up times to obtain product specifications and for returning the machine to performance conditions which maintain these specifications.

Tufting machines of the broadloom type may run one particular carpet style for a period of weeks before the run is terminated and the machine is set-up for another style. Since these machines have a large number of pulleys and belts for driving the main shaft, the yarn feed mechanism and the backing feed mechanism, changes in the product occur during a long production run due to the normal wear, slippage and stretching of the belts and loosening of the pulleys. These changes occur gradually and are normally unnoticed by the operators until the product is far beyond specification.

In many instances after a carpet run is changed and a different style is run, it becomes necessary to change back to produce an additional run of the original style. This entails a resetting up of the machine to produce the original specifications of the carpet. When carpet produced by different runs are compared the results can be strikingly different. The operators first set the machine to where they believe the runs are compatable, carpet is run and compared. Readjustments are made and again compared. This trial and error set up can be quite expensive and rarely is the machine set so as to produce a run completely compatable with the original run.

The paraters controlled by the tufting machine, aside from the pattern itself, which affect the specification of the carpet are the pile height and the number of stitches tufted into the backing per inch thereof, which together with the gauge and the type of yarn and the backing material determine the density of the carpet. The pile height is determined by the position of the loopers below the bedplate and the amount of yarn fed to the needles per stitch. The number of stitches tufted per inch depends on the stitching speed and the fabric feed. Backing fabric tension may also affect the stitches per inch. The operators therefore have a number of variables to adjust in order to try to meet the original carpet specification; hence, the difficulty in obtaining the specifications.

SUMMARY OF THE INVENTION

The present invention provides a means for monitoring the major parameters of a tufting machine to detect the occurrence of belt wear and slipping and loose pulleys and to reduce setup time to bring the machine back to the original specifications during a run or after a run change. It also provides an accurate output count of carpet produced by the machine. In this regard present output detectors give inaccurate output productivity since the readings are taken while the carpet backing are under the high tension imposed during the tufting process. When the carpet leaves the machine it shrinks and the actual output is less than the measured output.

The invention provides means for measuring the rotational speeds of certain of the tufting machine shafts, selecting combinations of two of such speeds to obtain the ratio thereof to give a representation of a performance parameter, comparing the ratio during operation and adjusting the machine accordingly. More specifically, the speed of the main shaft, the front and rear backing cloth rollers, the backing feed input and the yarn feed rollers are determined. The ratio of yarn feed to backing cloth feed is determined to obtain a representation of carpet density; the ratio of main shaft speed to backing cloth feed is determined to obtain a representation of stitches per unit of length; the ratio of the speeds of the front and rear backing cloth feed rolls is determined to obtain a representation of backing cloth tension; and the ratio of main shaft speed to yarn feed is determined to obtain a representation of pile height. This information can be monitored continuously to identify departures from original settings and corrections made when necessary.

The shaft speeds may be obtained by a sensor that senses the rotation of a gear by sensing the passage of gear teeth. The sensor then generates a pulse for each tooth as the tooth passes the sensor. The pulse train can then be selectively transmitted to a speed ratio indicator where two such pulse trains from different locations are counted and divided. In certain cases a rate multiplier can be applied to a single pulse train, e.g. the rear backing fabric feed, to obtain a corrected pulse train which is then counted to give a true output productivity.

Consequently, it is a primary object of the present invention to provide a method and apparatus for monitoring the operation of a tufting machine to detect drive belt slippage due to worn or improperly adjusted belts, and to detect stitch rate and yarn feed changes caused by worn belts or loose pulleys.

It is another object of the present invention to provide a method and apparatus for returning a tufting machine to original specification during a run or after a run change.

BRIEF DESCRIPTION OF THE DRAWINGS

The particular features and advantages of the invention as well as other objects will become apparant from the following description taken in connection with the accompanying drawings, in which:

FIG. 1 is a transverse cross sectional view of a tufting machine for producing loop pile carpet;

FIG. 2 is an end elevational view of the tufting machine illustrating the various drive elements and the associated monitor detectors;

FIG. 3 is a fragmentary plan view in diagrammatic form of the end of the tufting machine illustrated in FIG. 2 showing the remaining detectors;

DESCRIPTION OF THE PREFERRED EMBODIMENT

Figure 4:
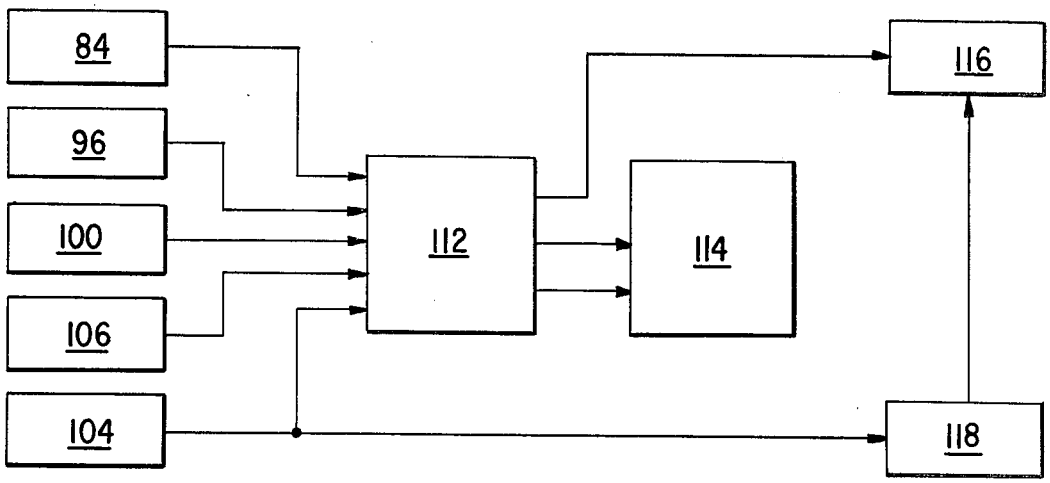
FIG. 4 is a diagrammatic view of the monitoring apparatus.

Referring now to the drawings, there is illustrated in FIG. 1 a tufting machine 10 having a frame comprising of base 12 and a head 14 disposed above the base 12. The base 12 includes a bed plate 16 across which a fabric F is adapted to be fed by a pair of feed rolls 18 and take-off rolls 20 rotatably driven as hereafter described.

Mounted in the head 14 for vertical reciprocation is a push rod 22 to the lower end of which is received a needle bar 24 which in turn carries a plurality of needles 26 that are adapted to penetrate the fabric F on the bed plate 16 upon reciprocation of the needle bar 24 and to project loops of yarn therethrough. Endwise reciprocation is imparted to the push rod 22 and thus the needle bar 24 and needles 26 by a link 28 which is pivotable connected at its lower end to the push rod 22 and at its upper end to an eccentric 30 on a driven rotary main shaft 32 that is journalled longitudinally of the head 14. A motor 34 at each end of the machine drives the main shaft 32 through belts and pulleys as hereafter described. While a plurality of push rods 22, links 28, eccentrics 30 and needles 26 are normally provided along the main shaft 32, only one set thereof is illustrated in the drawings.

Beneath the bed plate 16 there is journalled an oscillating looper shaft 36 which is arranged parallel to the main shaft 32 and which carries a looper 38. Each looper 38 cooperates with a needle 26 to seize a loop of yarn presented thereby and holds the same as the needle is withdrawn on its return stroke, after which the looper retracts to release the loop. While, to simplify the disclosure only a single looper 36 is shown, it is understood that one looper is provided for each needle in the machine.

Yarn Y is fed to the needles 26 by a yarn feed roller assembly 40 having a multiplicity of rollers 42 and 44 which may be mounted on the head of the tufting machine as illustrated and driven as hereafter described. The amount of yarn supplied to the needles of the tufting machine is determined by the rotational speed of the feed rollers on which the yarn strands are wound, so that with a fixed needle stroke the amount of yarn supplied to the needle determines the pile height of the pile fabric produced.

Fastened to the output shaft of the motors 34 and the main shaft 32 are respective fixed pulleys 46 and 48 of diameters selected to give the desired speed reduction, and a belt 50 is trained about the pulleys to drive the main shaft. Two other pulleys 52 and 54, these being of the variable pitch type, are also fastened to the main shaft 32. The fabric feed rolls 18 and the take-off rolls 20 are driven through respective reduction boxes 56 and 58 having respective input shafts 60 and 62. A variable pitch pulley 64 is fastened on the shaft 60 and a similar pulley 66 is fastened on shaft 62. A belt 68 is trained about the pulleys 52 and 64 to drive the input shaft 60 of the reducer 56 and thus the rolls 18. Another belt 70 is trained about the pulleys 64 and 66 and a pair of idler pulleys 72 and 74 to drive the input shaft 62 and thus the rolls 20 through the reducer 58. Similarly, a variable pitch pulley 76 is fastened to an end of the shaft 78 on which the rollers 42 are mounted, and a belt 80 is trained about the pulleys 76 and 54 to drive the roller assembly from the main shaft 32.

In order to monitor the aforesaid tufting parameters, the speed of the main shaft, the front and rear fabric feed rolls, the backing drive input and the yarn feed rollers are determined, and certain of these are made into ratios. The speeds may be determined by proximity probes, rotary pulse generators or other known means. However, the proximity probes are used in this embodiment because of their simplicity and adaptability to the instrumentation. The proximity probes may be a digital magnetic or conductive pick-up such as the model LMP-EF or PSA-Ef manufactured by Red Lion Controls of York, Pa., which emit an output when sensing metal and no output when not sensing metal. Thus, if a gear is fastened on the shaft whose speed is to be determined, the probe or sensor can count teeth and emit a pulse for each tooth as it passes the sensor, thereby generating a pulse train which can be counted per unit of time to determine the rotational speed of the shaft.

Thus, a gear 32 is fastened to the main shaft 32 and a sensor 84 is mounted on a bracket 86 secured to the head of the tufting machine. The sensor 84 is positioned a small distance from the periphery of the gear teeth to sense passage thereof. With a sensor such as the model PSA-EF the sensing distance is nominally approximately 0.05 inch to turn on and 0.060 inch to turn off. In a similar manner a gear 88 is mounted on the shaft 78 of the rollers 42, a gear 90 on the input shaft 60 of the reducer 56, and gears 92 and 94 are fastened respectively on a roller 18 and a roller 20. A sensing probe 96 mounted on a bracket 98 senses the teeth of gear 88, a sensing probe 100 on a bracket 102 cooperates with gear 90, and sensors 104 and 106 on respective brackets 108 and 110 sense rotation of the respective gears 92 and 94.

Referring now to FIG. 4, the pulse trains generated by the sensors 84, 96, 100, 104 and 106 are transmitted to a selector switch 112 which receives and selects the signals that are transmitted therefrom to a speed ratio indicator 114 or to a digital tachometer 116 or to a rate multiplier 118 as hereafter described. The selector switch is a simple mechanical double pole five position switch manually operated which is wired to transmit either the signal from the sensor 84 to the tachometer 116, or the signal from sensor 104 to the rate multiplier 118, or the pair of signals from sensors 84 and 96, or 100 and 96, or 84 and 100 or 104 and 106 to the speed ratio indicator 114. The rotational speed of the main shaft 32 can be determined as illustrated, if desired, and to this end, if the gear 82 has 60 teeth the reading is made directly in r.p.m. The output productivity of the machine can be determined accurately by transmitting the signal from the sensor 104 (or 106) to the rate multiplier 118 which constantly combines the signals from that sensor with a predetermined ratio dialed into the multiplier which may be a unit such as Model CA 510 manufactured by Red Lion Controls, This multiplication factor takes into account the fabric shrinkage that occurs after the fabric leaves the high tension conditions of the tufting machine. The value is determined by running a small length without the factor and then measuring the actual length. The reading on the tachometer is then a corrected value representing the output and can be converted into yardage when desired.

Figure 5:
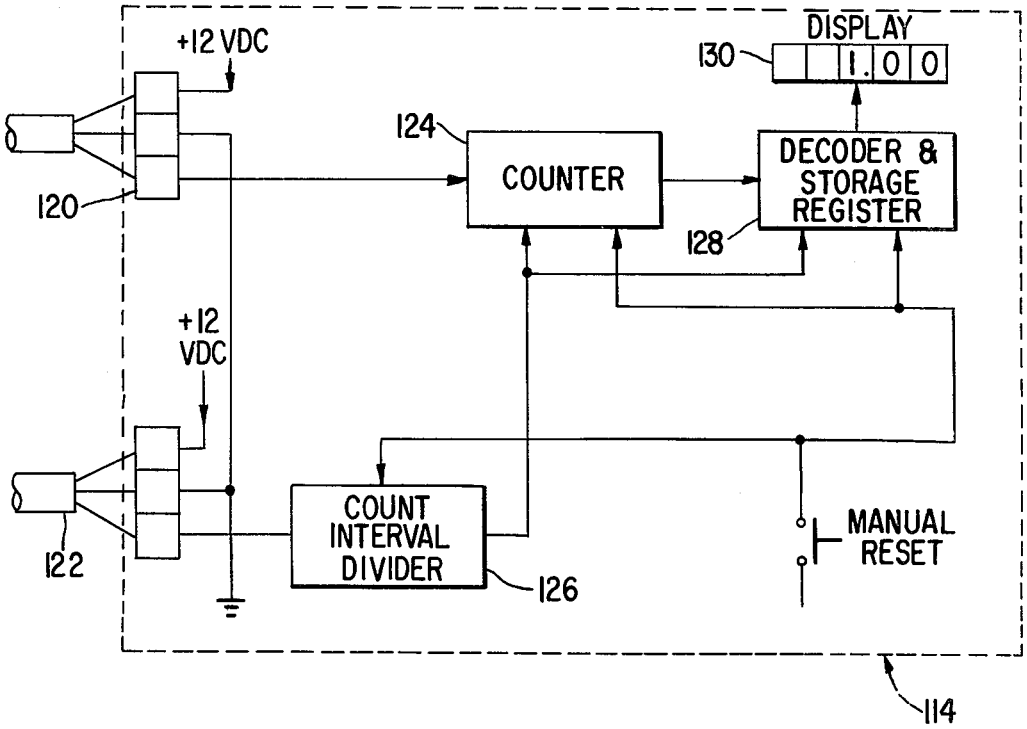
FIG. 5 is a diagrammatic view of a simplified speed ratio indicator.

Referring to FIG. 5, there is illustrated a simplified form of a speed ratio indicator similar to one manufactured by Red Lion Controls. It has an A channel 120 and a B channell 122, the B channel being the reference input or denominator, and the A channel the variable input or numerator. The signal at the A channel is connected to a counter 124 and the B channel signal is connected to a count interval divider 126. At the beginning of a count interval both the counter 124 and the count interval divider 126 are reset to zero by the conclusion of the preceding cycle. During a count interval the counter 124 and divider 126 accumulate their respective counts. When the total count in the divider 126 equals a preselected number, e.g. 1,000 pulses, a store signal transfers the count of the counter 124 to a storage register 128 where the count is stored, decoded and displayed on the display 130. At the same time the counter 124 and divider 126 are reset to zero. The readout on display 130 is then the number of counts received on the A channel per the preselected number of counts e.g. per 1,000 on the B channel, i.e., the ratio of the input at 120 to that received at 122. When identical gears are used with the sensors 84 etc. the readout is a true ratio.

The speed ratios selected were those of the main shaft 32 to the input shaft 60 of the fabric feed reducer, which is a representation of the stitches per inch of the fabric; the main shaft to the speed of the rollers 42 which is a representation of the pile height; the speed of the rollers 42 to the input shaft 60, which is a representation of the density; and the ratio of the speed of the rollers 18 to the rollers 20 which represents the tension of the backing cloth. Thus, the signals from sensors 84 and 100 are selectively fed to the indicator 114 to give the stitches per inch, the signals from sensors 84 and 96 give the pile height. the signals from sensors 96 and 100 give the density and those from sensors 104 and 106 give the cloth tension.

In operation after a new run is commenced, the selected ratios are monitored and if there is a change during the run the belts and/or the variable pulleys can be adjusted until the ratio returns to the initial value. A re-run can also be made by reestablishing the initial ratios as aforesaid. Thus, the run can be monitored and when changes occur, correction can be made before the carpet is too far out of specification. Moreover, when a re-run is made, little carpet need be wasted if the ratios of an earlier run are maintained for later use and the later run is reset to these values.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed therein is:

1. In combination with a tufting machine having a main shaft, means for rotating said main shaft, means for feeding a backing fabric through the machine, a plurality of needles disposed on one side of said backing fabric transverse to the direction of feed of said backing fabric, means for reciprocating said needles into and out of said backing fabric in timed relationship with said main shaft, means including a roller for feeding yarn to said needles, means for rotating said roller, and a plurality of hooks disposed on the opposite side of said backing fabric from said needles for cooperating with said needles to form stitches of pile extending from said backing fabric, apparatus for monitoring the pile height of the stitches extending from the pile fabric produced comprising means for determining the rotational speed of said main shaft, means for determining the rotational speed of said roller, and means for obtaining and displaying the ratio of one of said speed to the other of said speed.

2. In combination with a tufting machine as recited in claim 1 wherein said means for feeding the backing fabric includes a fabric feed roll and rotatable drive means for rotating said fabric feed roll, apparatus for monitoring the number of stitches of pile inserted into said backing fabric per unit of backing fabric fed through said machine comprising, means for determining the rotational speed of said rotatable drive means, and means for obtaining and displaying the ratio of said rotational speeds of said main shaft and said rotatable drive means.

3. In combination with a tufting machine as recited in claim 1 wherein said means for feeding the backing fabric includes a fabric feed roll, and rotatable drive means for rotating said fabric feed roll, apparatus for monitoring the density of the pile fabric produced comprising, means for determining the rotational speed of said rotatable drive means, and means for obtaining and displaying the ratio of said rotational speeds of said roll and said rotatable drive means.

4. In combination with a tufting machine as recited in claim 2 including means for obtaining and displaying the ratio of said rotational speeds of said roller and said rotatable drive means, thereby to monitor the density of the pile fabric produced.

5. In combination with a tufting machine as recited in claim 1 wherein said means for feeding the backing includes a first roll located before the needles relative to the direction of fabric feed, and a second roll located after the needles relative to the direction of fabric feed, and means for rotating said rolls, apparatus for monitoring the tension in the backing fabric between said rolls comprising means for determining the rotational speed of said first roll, means for determining the rotational speed of said second roll, and means for obtaining and displaying the ratio of the speed of one of said first and second roll speed to the other of said first and second roll speed.

6. In combination with a tufting machine as recited in claim 2 or 3 including a second fabric feed roll, one of said feed rolls being disposed before the needle relative to the direction of fabric feed and the other feed roll being disposed after the needles, and means for rotating said second fabric feed roll, apparatus for monitoring the tension in the backing fabric between said rolls comprising means for determining the rotational speed of said first roll, means for determining the rotational speed of said second roll, and means for obtaining and displaying the ratio of the speed of one of said first and second roll speed to the other of said first and second roll speed.

7. In the combination as recited in claim 1 wherein said means for determining the rotational speed of said main shaft and said roller comprises a gear having a multiplicity of teeth mounted for rotation with each of said main shaft and said roller, means for generating a pulse responsive to the passage of each tooth of a respective gear and means for counting the number of pulses generated for each gear.

8. In the combination as recited in claim 7 wherein said means for obtaining and displaying said ratio comprises means for counting the number of pulses representing said one of said speed for a preselected count of pulses representing the other of said speed.

9. In combination with a tufting machine having a main shaft, means for rotating said shaft, means for feeding a backing fabric through the machine including a fabric feed roll and rotatatable drive means for rotating said fabric feed roll, a plurality of needles disposed on one side of said backing fabric transverse to the direction of feed of said backing fabric, means for reciprocating said needles into and out of said backing fabric in timed relationship with said main shaft, means for feeding yarn to said needles, means for rotating said roller, and a plurality of hooks disposed on the opposite side of said backing fabric from said needles for cooperating with said needles to form stitches of pile in said fabric, apparatus for monitoring the number of stitches of pile inserted into said backing fabric per unit of backing fabric fed through said machine comprising, means for determining the rotational speed of said rotatable drive means, means for determining the rotational speed of said main shaft, and means for obtaining and displaying the ratio of one of said speed to the other of said speed.

10. In combination with a tufting machine as recited in claim 9 wherein said means for feeding yarn includes a roller and means for rotating said roller, apparatus for monitoring the density of the pile fabric produced comprising, means for determining the rotational speed of said roller, and means for obtaining and displaying the ratio of said rotational speeds of said roll and said rotatable drive means.

11. In combination with a tufting machine as recited in claim 9 including a second fabric feed roll, one of said feed rolls being disposed before the needles relative to the direction of fabric feed and the other feed roll being disposed after the needles, and means for rotating said second fabric feed roll, apparatus for monitoring the tension in the backing fabric between said rolls comprising means for determining the rotational speed of said first roll, and means for determining the rotational speed of said second roll, and means for obtaining and displaying the ratio of the speed of one of said first and second roll speed to the other of said first and second roll speed.

12. In the combination as recited in claim 9 wherein said means for determining the rotational speed of said main shaft and said rotatable drive means comprises a gear having a multiplicity of teeth mounted for rotation with each of said main shaft and rotatable drive means, means for generating a pulse responsive to the passage of each tooth of a respective gear, and means for counting the number of pulses generated for each gear.

13. In the combination as recited in claim 12 wherein said means for obtaining and displaying said ratio comprises means for counting the number of pulses representing said one of said speed for a preselected count of pulses representing the other of said speed.

14. In combination with a tufting machine having a main shaft, means for rotating said shaft, means for feeding a backing fabric through the machine including a fabric feed roll and a rotatable drive means for rotating said fabric feed roll, a plurality of needles disposed on one side of said backing fabric transverse to the direction of feed of said backing fabric, means for reciprocating said needles into and out of said backing fabric in timed relationship with said main shaft, means including a roller for feeding yarn to said needles, means for rotating said roller, and a plurality of hooks disposed on the opposite side of said backing fabric from said needles for cooperating with said needles to form stitches of pile in said fabric, apparatus for monitoring the density of the pile fabric produced comprising, means for determining the rotational speed of said roller, means for determining the rotational speed of said rotatable drive means, and means for obtaining and displaying the ratio of said rotational speeds of said roll and said rotatable drive means.

15. In combination with a tufting machine as recited in claim 14 including a second fabric feed roll, one of said feed rolls being disposed before the needles relative to the direction of fabric feed and the other feed roll being disposed after needles, and means for rotating said second fabric feed roll, apparatus for monitoring the tension in the backing fabric between said rolls comprising, means for determining the rotational speed of said first roll, means for determining the rotational speed of said second roll, and means for obtaining and displaying the ratio of the speed of one of said first and second roll speed to the other of said first and second roll speed.

16. In the combination as recited in claim 14 wherein said means for determining the rotational speed of said rotatable drive means and said roller comprises a gear having a multiplicity of teeth mounted for rotation with each of said rotatable drive means and said roller, means for generating a pulse responsive to the passage of each tooth of a respective gear, and means for counting the number of pulses generated for each gear.

17. In the combination as recited in claim 16 wherein said means for obtaining and displaying said ratio comprises means for counting the number of pulses representing said one of said speed for a preselected count of pulses representing the other of said speed.

18. In a method of tufting pile fabric in a tufting machine having a rotating main shaft, a needle reciprocated in timed relationship to the rotation of the main shaft, and a yarn feed roller for feeding yarn to the needle, determining the rotational speed of the main shaft, determining the rotational speed of the roller, obtaining and displaying the ratio of one of said speeds to the other of said speeds to monitor the pile height of the pile fabric, and modifying the speed of at least one of the main shaft and the roller to maintain said ratio substantially constant.

19. In a method of tufting pile fabric in a tufting machine having a rotating main shaft, a needle reciprocated in timed relationship to the main shaft, and at least a roll for feeding a backing fabric in one direction for penetration by said needle, determining the rotational speed of the main shaft, determining a rotational speed directly related to the rotational speed of said roll, obtaining and displaying the ratio of one of said speeds to the other of said speeds to monitor the stitches inserted per unit of length of backing fabric, and modifying the speed of at least one of the main shaft and said roll to maintain said ratio substantially constant.

20. In a method of tufting pile fabric in a tufting machine having a reciprocating needle penetrating a backing fabric to insert yarn therein, feeding yarn to said needle by a yarn feed roller, feeding the backing fabric relative to the needle by at least a feed roll, determining the rotational speed of said roller, determining a rotational speed directly related to the rotational speed of said roll, obtaining and displaying the ratio of one of said speeds to the other of said speeds to monitor the density of the pile fabric, and modifying the speed of at least one of the roller and roll speed to maintain said ratio substantially constant.

* * * * *

UNITED STATES PATENT AND TRADEMARK OFFICE

CERTIFICATE OF CORRECTION

PATENT NO. : 4,237,802

DATED : December 9, 1980

INVENTOR(S) : Jimmie D. Scott

It is certified that error appears in the above—identified patent and that said Letters Patent is hereby corrected as shown below:

Column 4, line 3, "gear 32" should be -- gear 82 --

Claim 15, line 5, -- the -- has been deleted before "needles"

Signed and Sealed this

*Thirty-first* Day of *March 1981*

[SEAL]

*Attest:*

RENE D. TEGTMEYER

*Attesting Officer*

*Acting Commissioner of Patents and Trademarks*